US007594420B2

(12) United States Patent
Len

(10) Patent No.: US 7,594,420 B2
(45) Date of Patent: Sep. 29, 2009

(54) WHEEL REPAIR MACHINE AND METHOD OF USE

(76) Inventor: Brian Len, 9509 NW. 38th St., Coral Springs, FL (US) 33065

( * ) Notice: Subject to any disclaimer, the term of this patent is extended or adjusted under 35 U.S.C. 154(b) by 0 days.

(21) Appl. No.: 12/103,580

(22) Filed: Apr. 15, 2008

(65) Prior Publication Data

US 2008/0257002 A1 Oct. 23, 2008

Related U.S. Application Data

(60) Provisional application No. 60/912,190, filed on Apr. 17, 2007.

(51) Int. Cl.
*B21D 41/02* (2006.01)
*B21D 3/14* (2006.01)
*B21J 13/04* (2006.01)

(52) U.S. Cl. ..... 72/316; 72/420; 72/447; 72/455; 72/479; 72/701; 29/283.5; 29/402.21; 269/71

(58) Field of Classification Search ..... 72/31.02, 72/311, 316, 447, 420, 455, 479, 701; 29/281.6, 29/283.5, 402.19, 402.21; 269/67, 69, 70, 269/71

See application file for complete search history.

(56) References Cited

U.S. PATENT DOCUMENTS

| | | | | | |
|---|---|---|---|---|---|
| 1,580,924 | A * | 4/1926 | Shannon | 227/106 |
| 1,786,847 | A * | 12/1930 | Hunt | 72/316 |
| 2,102,439 | A * | 12/1937 | Schildmeier | 72/311 |
| 2,244,927 | A * | 6/1941 | Vanstone et al. | 72/316 |
| 2,282,118 | A * | 5/1942 | Daniel | 72/293 |
| 2,489,815 | A * | 11/1949 | Rader | 72/311 |
| 5,303,573 | A * | 4/1994 | Douglas | 72/420 |
| 5,499,524 | A * | 3/1996 | Len | 72/420 |
| 6,367,303 | B1 * | 4/2002 | Hizono | 72/316 |

* cited by examiner

*Primary Examiner*—David B Jones
(74) *Attorney, Agent, or Firm*—David W Barman; Robert M. Schwartz

(57) ABSTRACT

The present invention is a novel machine for repairing damaged wheel rims whereby pressure is applied to a damaged rim from a plurality of pressure applicators, and whereby all of the pressure applicators may be used without impairing the sightline of the user.

15 Claims, 20 Drawing Sheets

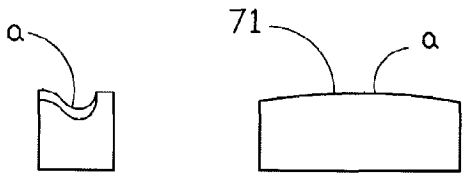
FIG.23 A
FIG.23 B
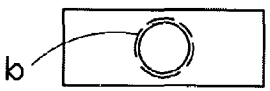
FIG.23 C
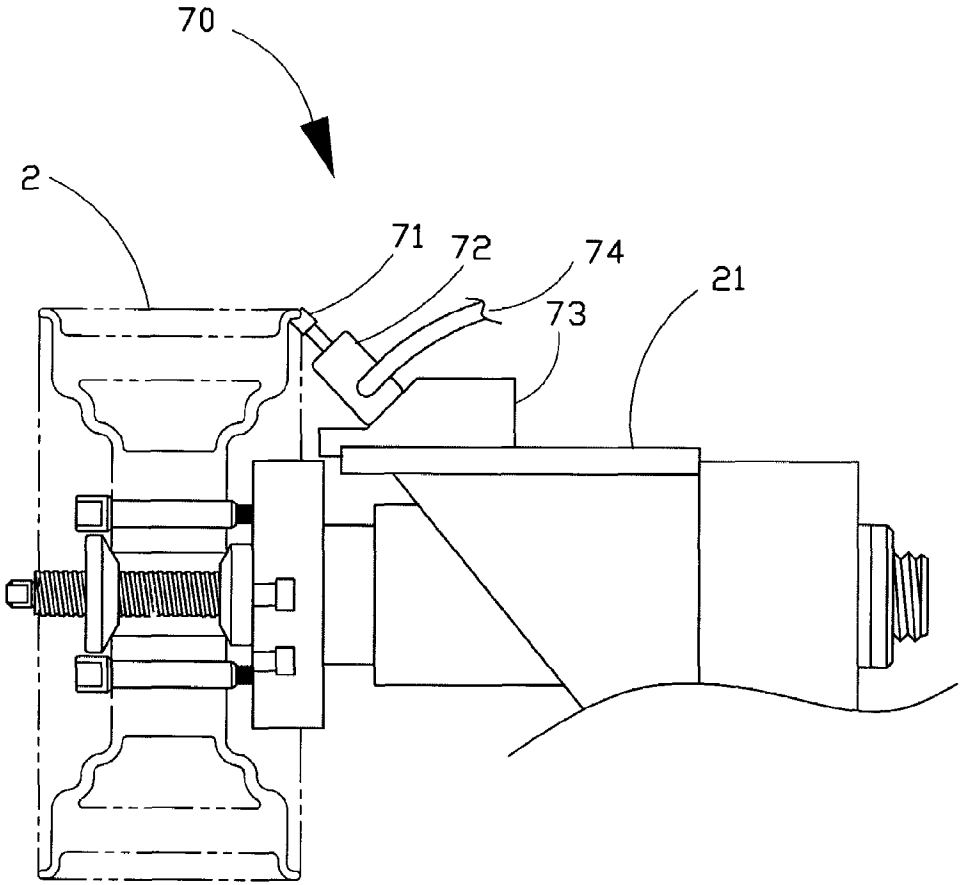
FIG.22

WHEEL REPAIR MACHINE AND METHOD OF USE

INDEX TO RELATED APPLICATIONS

This application claims the benefit of U.S. Provisional Patent Application Ser. No. 60/912,190 filed Apr. 17, 2007 the disclosure of which is incorporated herein by reference in its entirety.

BACKGROUND OF THE INVENTION

The present invention relates to a method and device for repairing wheel rims, and more particularly, to a method and device for repairing the rims of automobiles after the rims have been dented or bent out of shape.

As is well, known, the wheels of most, if not all motor vehicles, such as cars, trucks, motorbikes, etc., consist of two main parts: a circular metal or alloy rim and a rubber tire disposed circumferentially around the periphery of the rim. One of the main purposes of the rim is to provide structural strength to the tire.

During use, the wheel rims of motor vehicles may become damaged in a number of ways. For example, a wheel rim may become dented or fractured, or the wheel rim may be distorted from a circular shape. As well, portions of the rim may become worn, etc. Thus, after excessive use, especially when the vehicle is used in rough terrain or under heavy loads, or when the vehicle's wheels encounter a pothole or curb, the rim may become dented or bent so that the rims are no longer circular, but rather take on an "oval" shape. Such a bent or oval wheel rim can cause potentially serious problems to the proper and safe operation of the motor vehicle. If a wheel rim is in any way damaged, the motor vehicle wheel will be off balance, resulting in excessive vibration and may also result in premature loss of air pressure in the tires. In addition, even newly manufactured wheel rims after casting may be bent slightly out of shape and off balance, thus also posing a similar problem and a safety hazard.

Decorative and custom wheel rims are very popular. These rims may cost several hundreds to several thousands of dollars for each rim. There is a need to be able to accurately and satisfactorily repair damaged rims.

In accordance with one aspect of the present invention, there is provided a machine useful for repairing the rims of wheels. The machine may be used with wheels of any composition including, but not limited to metals, metal alloys, composites and the like. According to a further aspect of the present invention, a method is provided for repairing the wheel rims of motor vehicles.

BRIEF SUMMARY OF THE INVENTION

The wheel rim repair machine of the present invention is a single unit that may repair all bent, dent, damaged, or another way disfigured aspects of a wheel rim. The outer rim refers to that decorative portion which faces away from the vehicle. The inner rim refers to that portion that is mounted facing towards the vehicle. The machine of the present invention provides numerous advantages over machines that are used for repairing damaged wheel rim. The advantages include the ability to have interchangeable wheel rim shaping shoes. The shaping shoe is typically placed on the interior of a rim during repair and pressure is applied outward in order to reshape a wheel rim. The interchangeable shoes may be selected based on their size, shape, composition, and/or hardness level.

The machine of present invention has further advantages in that an operator has clear and unobstructed sight lines to all aspects of the wheel rim before and during repair. A further advantage provides an operator to select from a plurality of applicators in order to provide the desired pressure in order to repair a damaged wheel rim. Typically, damaged wheel rims are dented or bent from their original configuration. The application of pressure is used to push the metal back into a shape congruent with its original configuration. The various pressure points could be used either together (i.e. simultaneously) or independently of each other.

Another advantage of the present machine is that the operator's hands are not in direct contact with hydraulic rams when applying pressure so that there is less chance of an operator being injured.

In one embodiment the pressure applicators employ the use of hydraulic pressure from a manual or hand operated hydraulic source. Alternatively, the machine may provide hydraulic pressure from an automated source.

In one embodiment the present invention is a machine for repairing damaged wheel rims comprising:

a. a rotational wheel rim holding spindle;

b. securing means for attaching a wheel rim to said spindle;

c. at least a first movable, hydraulic platform; and d. at least one removable shaping shoe.

The machine spindle may be rotated by moving a wheel rim secured thereto. The spindle may be rotated manually or mechanically by a motor. If a motor is used it is preferred that the machine motor has a clutch to engage and disengage rotation of a wheel rim.

The machine may have a second movable, hydraulic platform that moves independent of said first platform.

The first movable hydraulic platform supports a shaping shoe for applying pressure on the interior portion of the interior of a wheel rim.

The removable shoe may have varying sizes, shapes, compositions, and hardness levels.

The second, and any additional movable hydraulic platforms hold a shaping article to repair damaged wheel rims.

The machine may have a hydraulic lifting arm on the outer (decorative) portion of a wheel rim. The lifting arm preferably supports a shaping shoe.

The machine may apply any one or all of six different application points of pressure to repair damaged wheels comprising:

a. pressure application point from said first hydraulic platform on the interior of the inner wheel rim portion;

b. pressure application point from said second hydraulic platform applied to the exterior of the outer wheel rim portion;

c. pressure application point from said second hydraulic platform on the inner portion of the interior part of a wheel rim;

d. pressure application point from said second platform on the interior portion of the exterior part of a wheel rim;

e. pressure application point from said lifting arm on the exterior portion of the exterior part of a wheel rim; and f. pressure application point from any hydraulic source to the outer portion of the inner wheel rim.

Preferably, any of said pressure applications may be used without interfering with the sight line between a user and a wheel rim.

The lifting arm preferably moves independent of each of said first and second platforms.

Also, any of the pressure points may be applied individually or in combination.

Also contemplate is a method of repairing a damaged wheel rim comprising the steps of:

a. mounting a damaged rim on the spindle of a machine as described;

b. identifying the portion or portions of a wheel rim in need of repair;

c. selecting an appropriate pressure application point for repair of said damaged wheel rim;

d. applying pressure from the machine to the area in need of repair;

e. optionally, applying additional pressure to additional regions of said wheel rim in need of repair;

f. removing the wheel rim from said machine.

The method contemplates all applications of pressure to the wheel rim are in an unobstructed sight line from the user.

BRIEF DESCRIPTION OF THE DRAWINGS

FIG. 22 shows a configuration of one type of wheel repair performed by the machine.

FIG. 23A shows repair shoe (71).

FIG. 23B shows a front view of repair shoe (71).

FIG. 23C shows a bottom view all of repair shoe (71) with tapped hole "b" to connect to cylinder rod end (72).

DETAILED DESCRIPTION OF THE PREFERRED EMBODIMENTS

Figure 1:
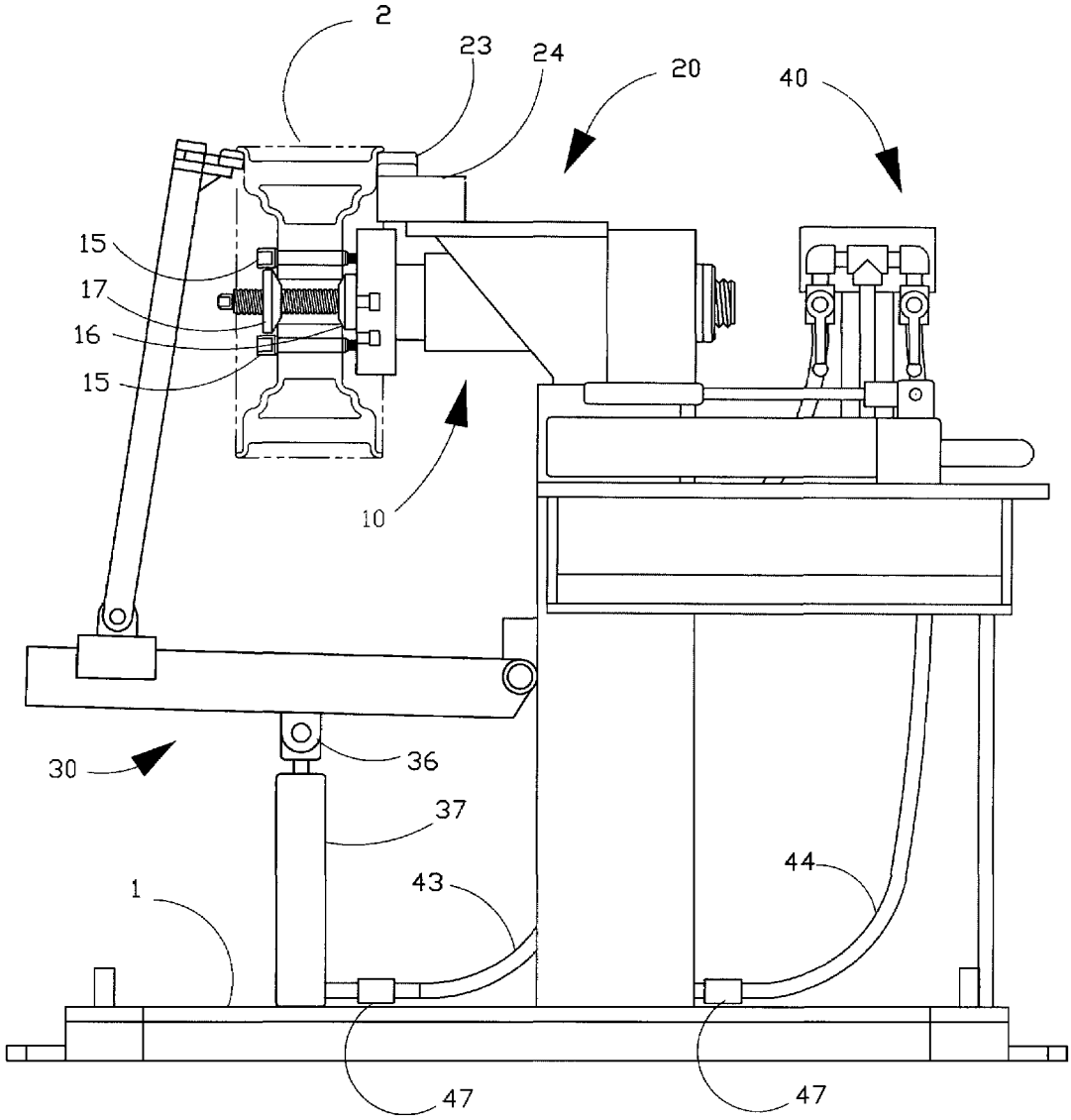
FIG. 1 is a side view of the machine.
Figure 2:
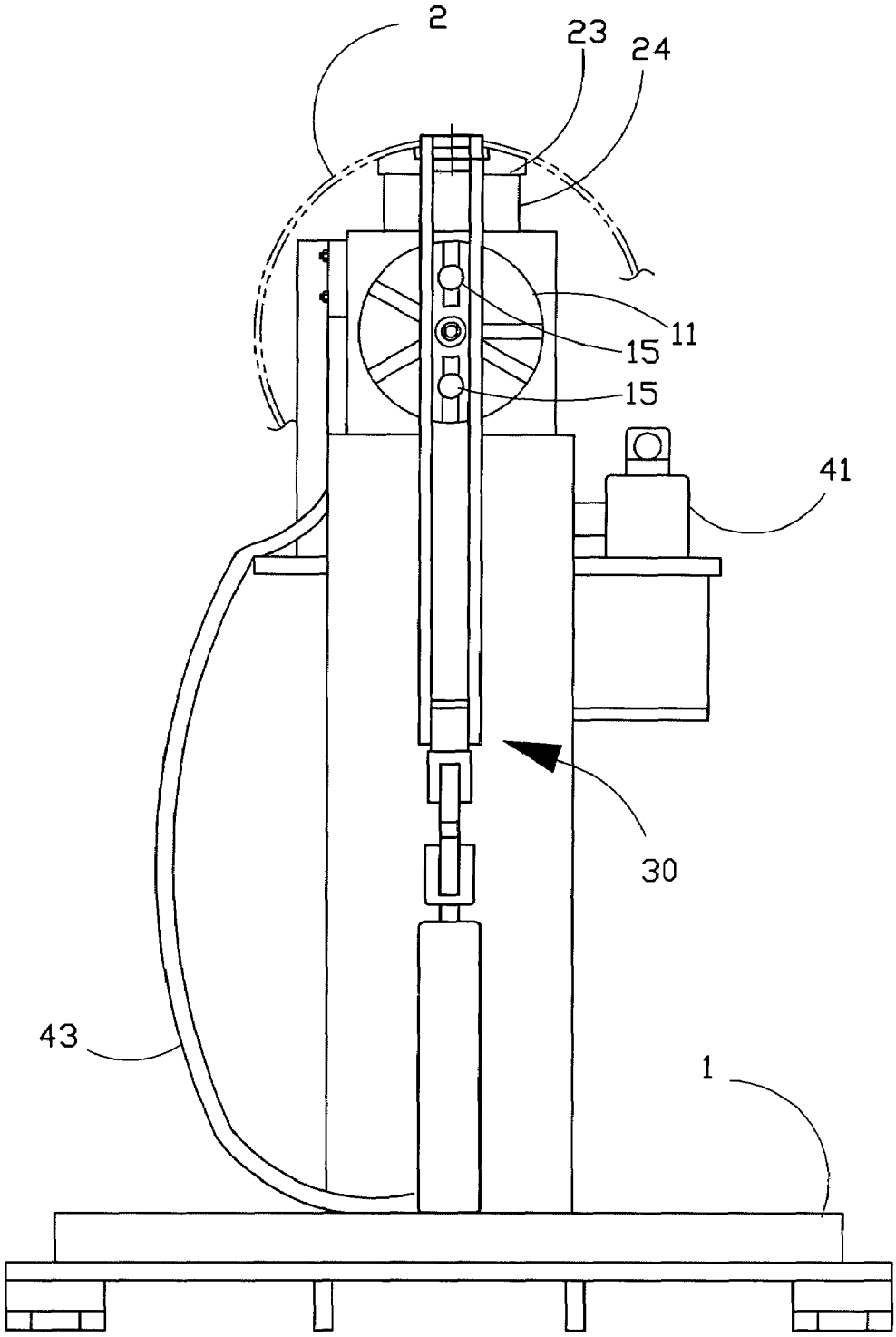
FIG. 2 is a front view of the machine.
Figure 3:
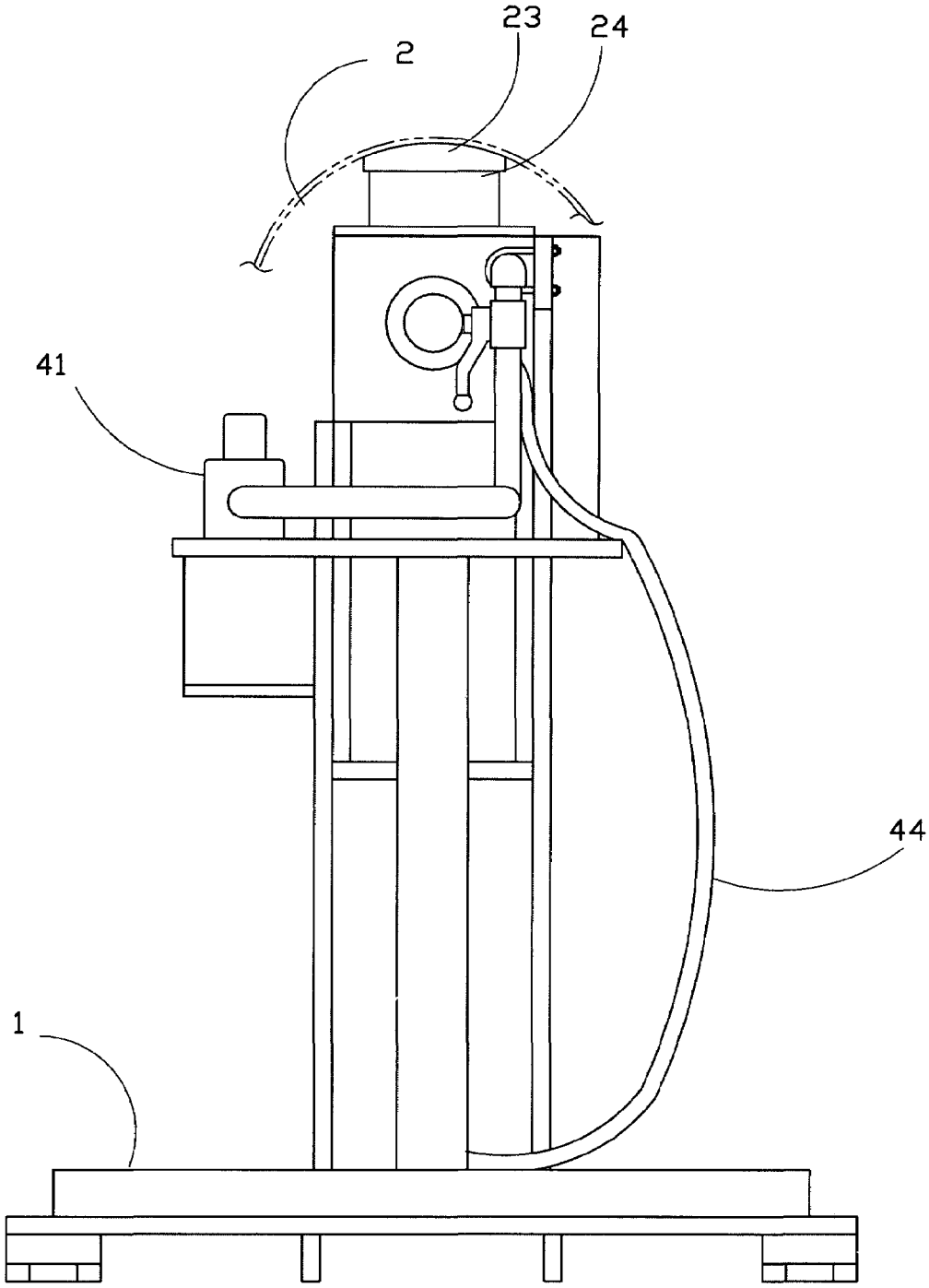
FIG. 3 is a rear view of the machine.
Figure 4:
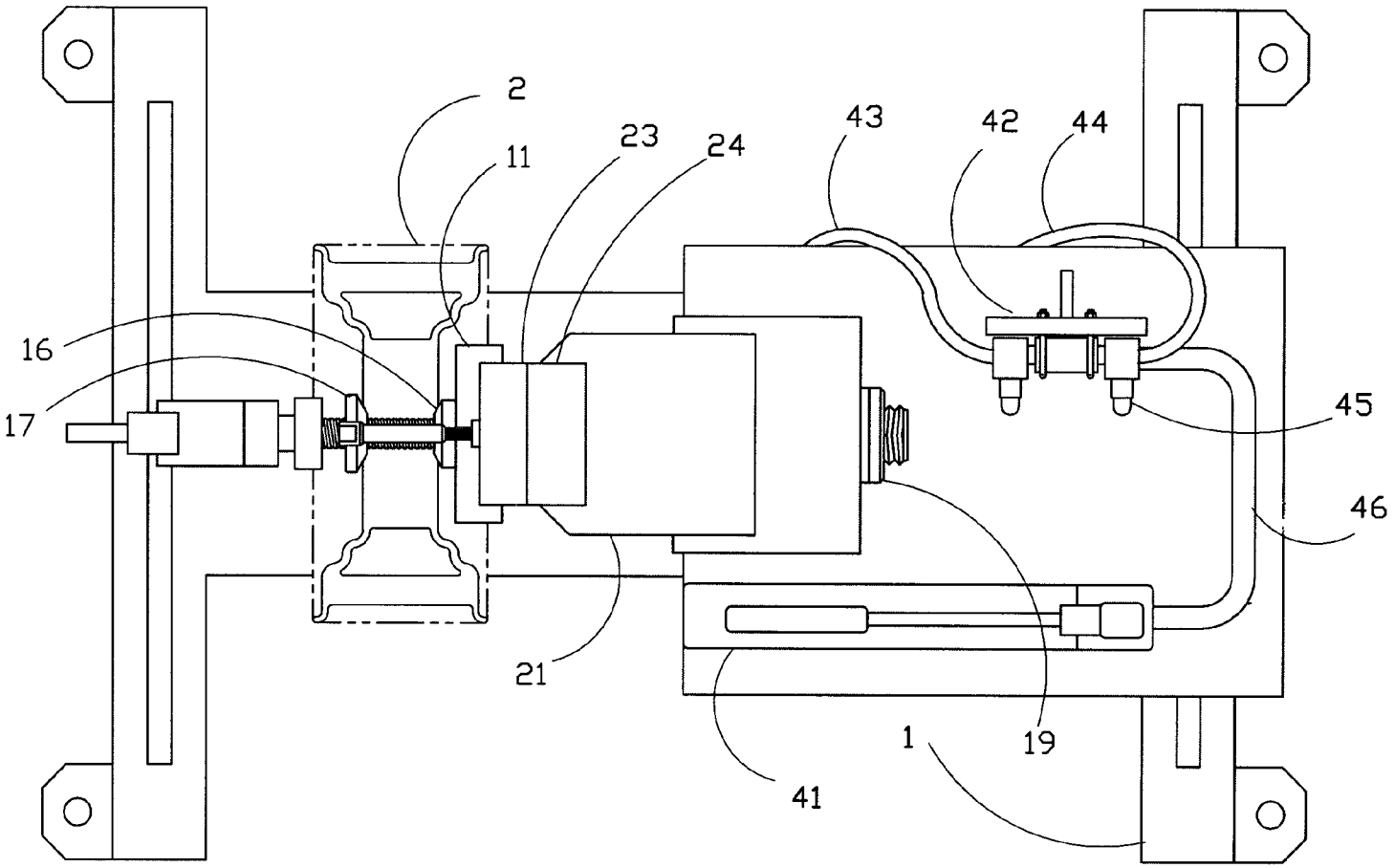
FIG. 4 is a top view of the machine.

The machine of the present invention has a frame structure 1 configured to hold tire rim 2. Tire rim 2 is secured on wheel centering cone 16 with wheel centering nut 17. Frame structure 1 further supports platform "A" assembly 20, platform "C" assembly 30, and hydraulic system assembly 40. Assembly 20 further supports axle mount assembly 10. Assembly 20 additionally supports riser 24 and shoe 23. Assembly 30 is movable by means of cylinder connection 36 that is connected to hydraulic cylinder 37 whereby hydraulic hose 43 connected at quick disconnect coupling 47 provides hydraulic lift ultimately to platform 30. Hydraulic hose 44 connected with quick disconnect coupling 47 ultimately provides hydraulic lift to platform 20 through hydraulic cylinder 26 and hydraulic cylinder connection 25.

In one embodiment hydraulic system assembly 40 may have manual hydraulic pump 41 that interacts with hydraulic on off valve 45 connected to hydraulic manifold 42.

Flexible hydraulic hose 44 and flexible hydraulic hose 46 emanate from hydraulic manifold 42. Axle mount assembly 10 has a wheel mount axle 11 that has a threaded a portion "a" and six "T" slots "b" That are configured so as to allow mounting a wheel rims with from four to six mounting holes. Axle 11 also has "T" bolts 14 on which wheel rim 2 are mounted and secured into position with "T" bolt nuts 15.

Axle mount assembly 10 further encompasses bearing 13 and bearing spacer 12 internally from bearing housing 18 and bearing spanner nut 19.

As depicted in FIGS. 7A-7D, wheel rim 2 rotates circularly along direction "a" such that any one of platform shoes 23, 34, or 82 may contact rim bent region "b". Any of platforms "A", "B", or "C" may be in retracted position "c" and selectively moved into engaged position "e" as desired. Engaged position "e" may be retracted into retracted position "c" as needed to observe the engagement of a platform shoe against bent region "b." Force line "f" Shows the line of force by which a user may apply hydraulic static pressure to the indentation via any of the platforms and shoes. Force lines "g" shows the lines of force by which a user may apply dynamic pressure to the opposite side of the rim via hand tools (e.g. cameras, dowels, and the like) not shown.

Platform 20 moves by hydraulic engagement of hydraulic cylinder 26 that engages hydraulic cylinder connector 25 by which movement is regulated to platform slide 21 on platforms slide way 22.

Figure 10B:
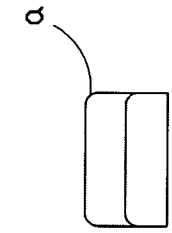
FIG. 10B is a side view of platform "A" shoe (23).
Figure 11B:
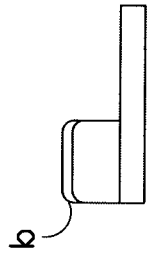
FIG. 11B is a side view of platform "C" shoe (34).
Figure 10A:
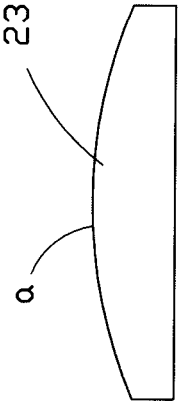
FIG. 10A is a front view of platform "A" shoe (23).
Figure 11A:
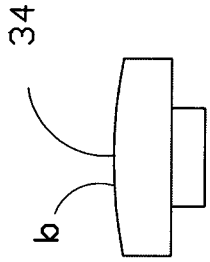
FIG. 11A is a front view of platform "C" shoe (34).
Figure 13A:
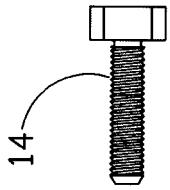
FIG. 13A is a front view of "T" bolt (14).
Figure 13B:
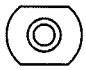
FIG. 13B is a side view of "T" bolt (14).

Shown in FIG. 10A shoe 23 has a unique curvature "a" that may be shaped to conform to any one of a number of unique wheel rims.

Shown in FIG. 10B shoe 34 has a unique curvature "a" that may be shaped to conform to any one of a number of unique wheel rims.

Figure 14A:
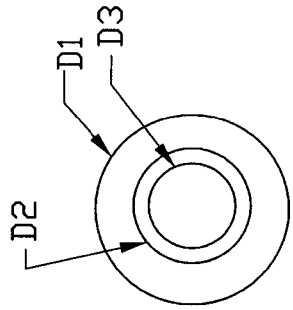
FIG. 14A is a front view of wheels entering cone (16).
Figure 12A:
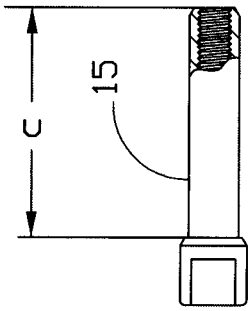
FIG. 12A is a front view of "T" bolt nut (15).
Figure 14B:
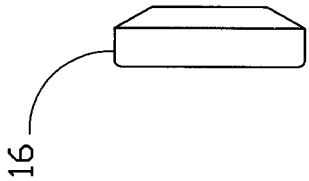
Figure 12B:
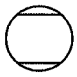
FIG. 12B is a side view of platform "C" shoe (34).

As shown in FIGS. 14A and 14B centering cone 16 may have suitable inner diameter D1, D2, or D3, to accommodate various sizes of wheel rims.

Platform "C" 30, supports arm 33 that supports shoe 34 for contacting the outer interior portion of wheel rim 2. Armed 33 may move along arm connection 32 that is subsequently horizontally movable along horizontal arm 31 of platform 30.

Horizontal arm 31 as slider stops 38 that Riche tricked the movement of arm connection 32 along horizontal platform 31.

Figure 18:
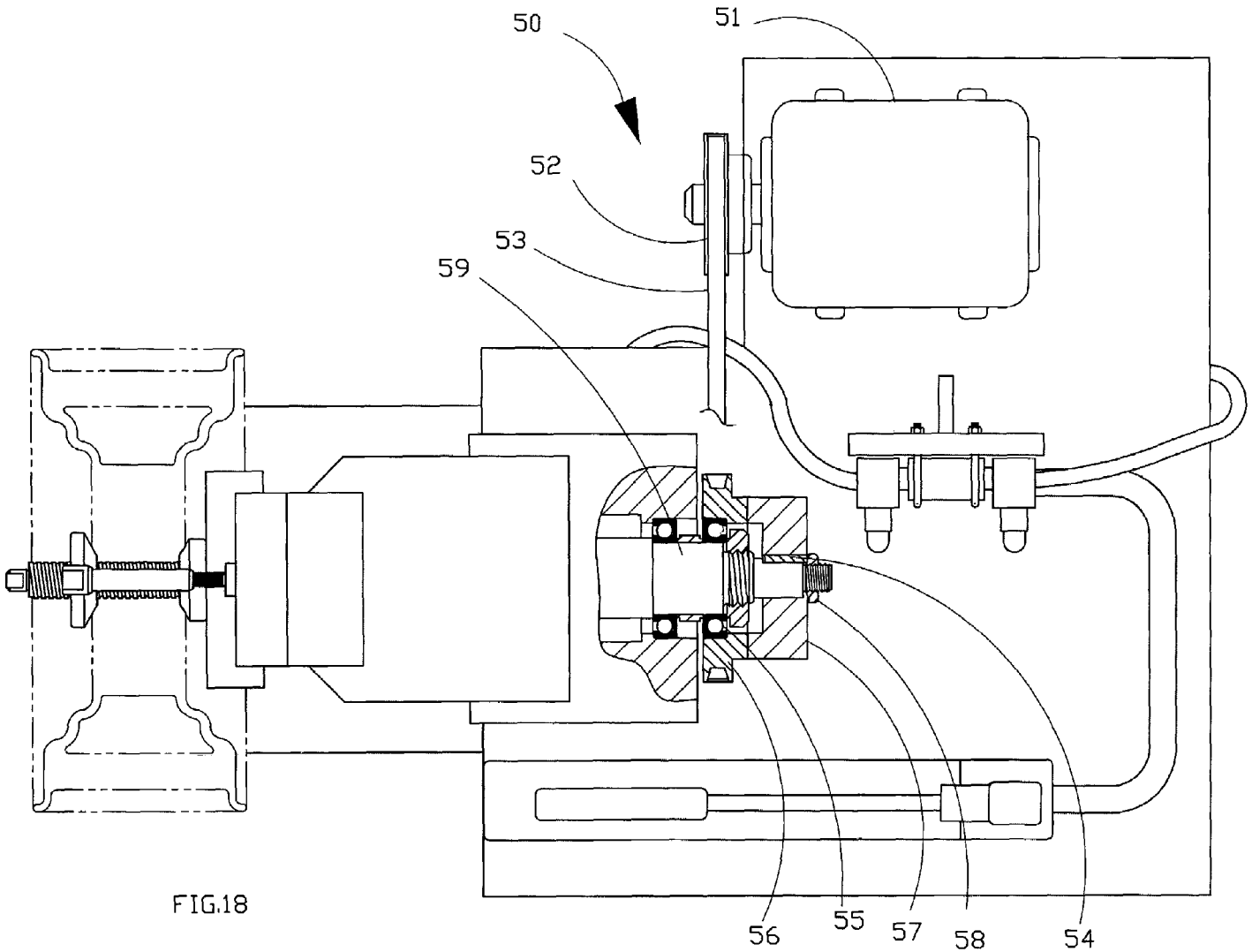
FIG. 18 is an alternative of embodiment with a motorized drive assembly.

As shown in FIG. 18, one embodiment may have motorized drive assembly 50. Assembly 50 has motor 51, "V" belt pulley 52 that engages "V" belt 53. Assembly 50 further accomplices bearing 55, drive pulley 56 drive connector plate 57, that interact with wheel mount axle 59 having nut 58.

Figure 20A:
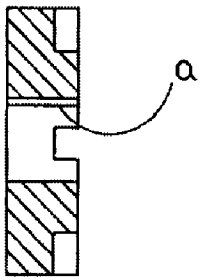
FIG. 20A is a half section of drive connector plate (57).
Figure 20B:
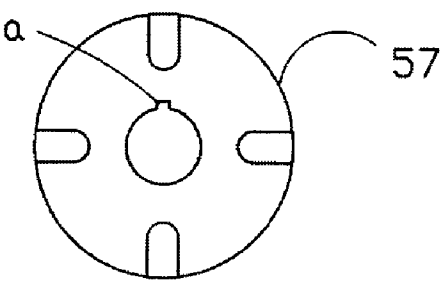
FIG. 20B is a front view of drive connector plate (57).

FIGS. 20A and 20B show tried connector plate 57 with keyseat "a" that will interact with drive key 54.

Dial indicator assembly 60 as dial indicator with magnetic mount 61 on platform 20.

In one embodiment as shown in FIG. 22, assembly 70 encompass shaping shoe 71 that is supported by hydraulic cylinder 72 connected to connector 73 that is supported on platform slide 21. Hydraulic hose 74 supplies required hydraulic fluid to hydraulic cylinder 70 to Shaping shoe 71 may have curvature "a" being concave, convex, or any desired configuration to shape wheel rim 2 as desired.

Figure 24:
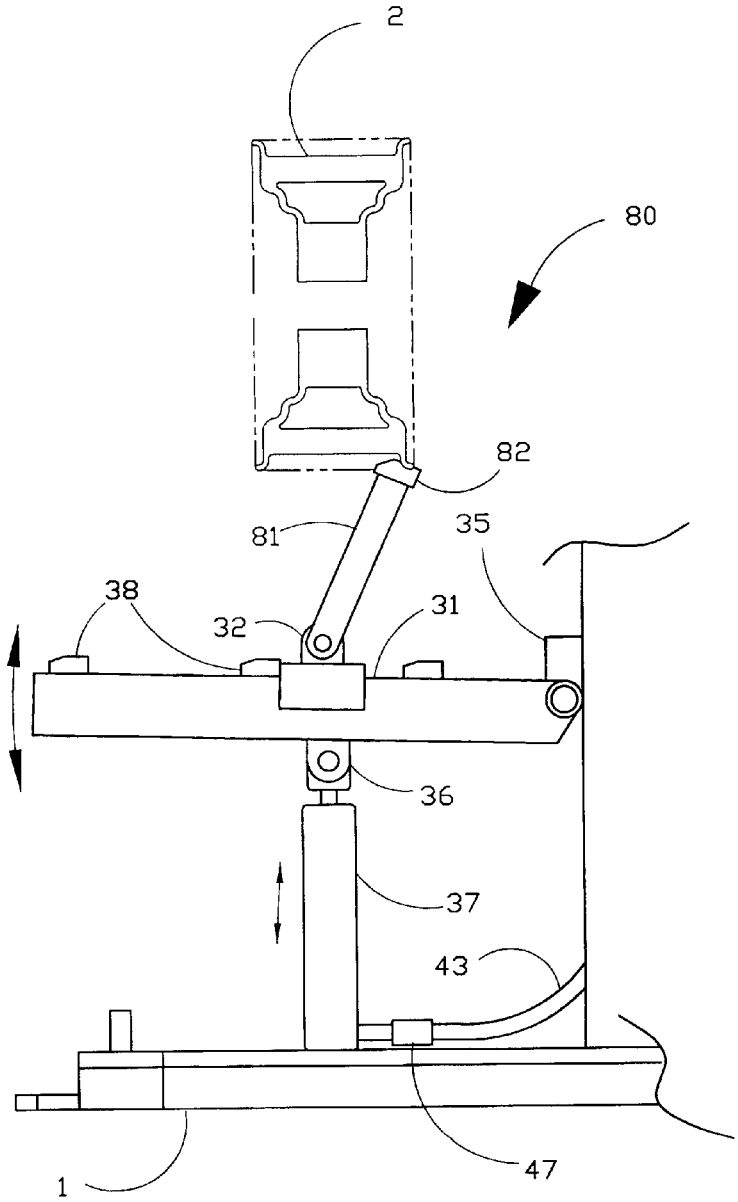
FIG. 24 shows alternate platform "C" assembly.

In an alternative embodiment, configuration 80, as shown in FIG. 24, alternative configuration of platform "C" 30 provides shaping shoe 82 contacting wheel rim 2. Shoe 82 supported on shoe platform 81 secured in sliding arm connection 32 on horizontal platform 31 of the assembly. The assembly is ultimately raised and lowered by hydraulic cylinder connection 36 that is connected to hydraulic cylinder 37 that receives the require hydraulic fluid through hose 43. The various pressure points could be used either together or independently of each other.

Shaping shoe 82 may have curvature "a" being concave, convex, or any desired configuration to shape wheel rim 2 as desired.

Figure 26:
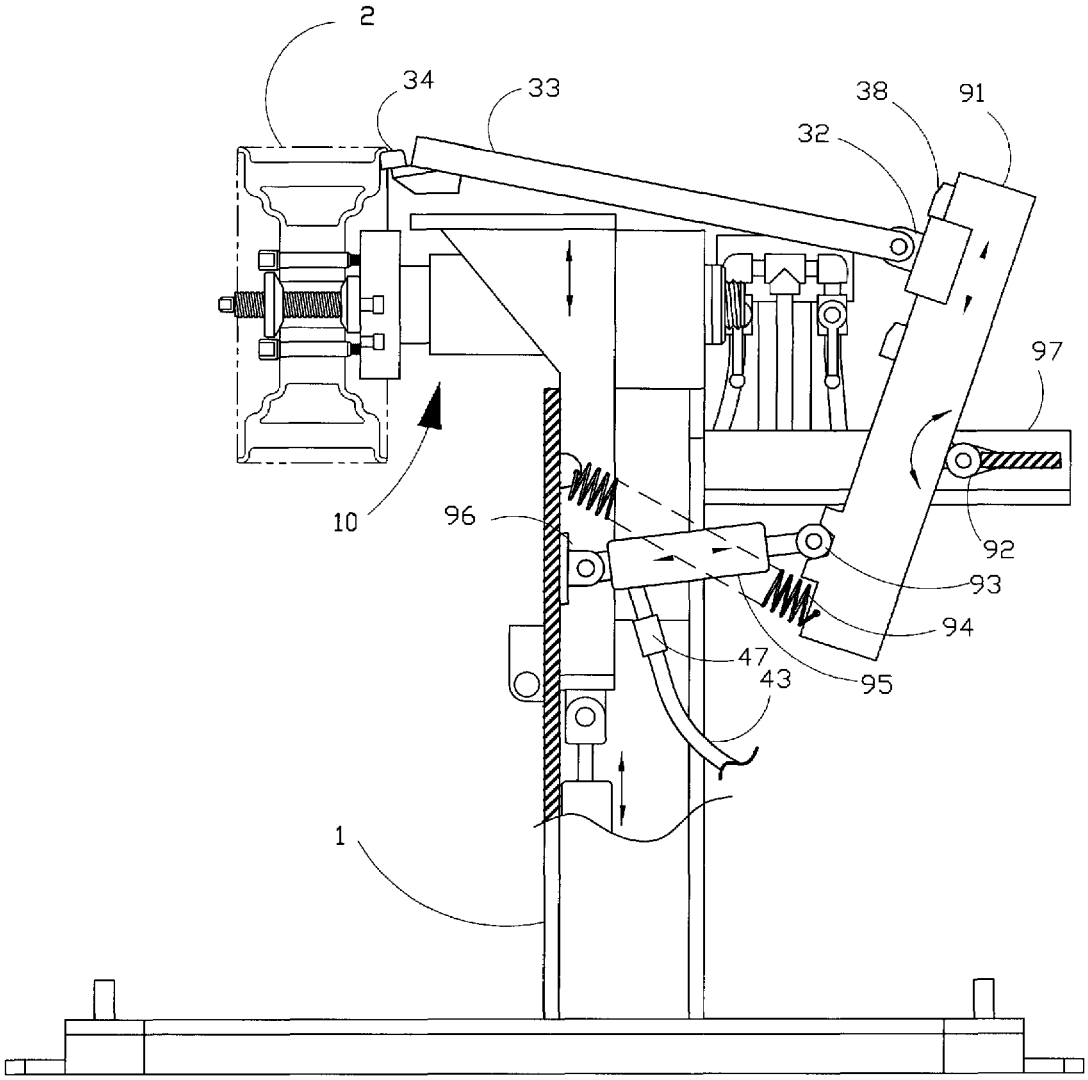
FIG. 26 is a partial section of FIG. 1 showing platform "E" assembly.

As shown in FIG. 26, platform "E" 97 supports rotating pressure bar 91 that moves when hydraulic cylinder 95 is engaged with hydraulic fluid from flexible hydraulic hose 43. Hydraulic cylinder 95 pivots on cylinder pivot mount 96 and contacts rotating pressure bar 91 at roller 93. Return Spring 95 urges rotating pressure bar 91 in the direction towards hydraulic cylinder 95. Hydraulic cylinder 95 prohibits rotating pressure bar 91 along pivot 92 such that platform "C" upper arm 33 connected to rotating pressure bar 91 at sliding on connection 32 applies pressure on platform shoes 34 that ultimately contacts wheel rim 2.

Figure 27:
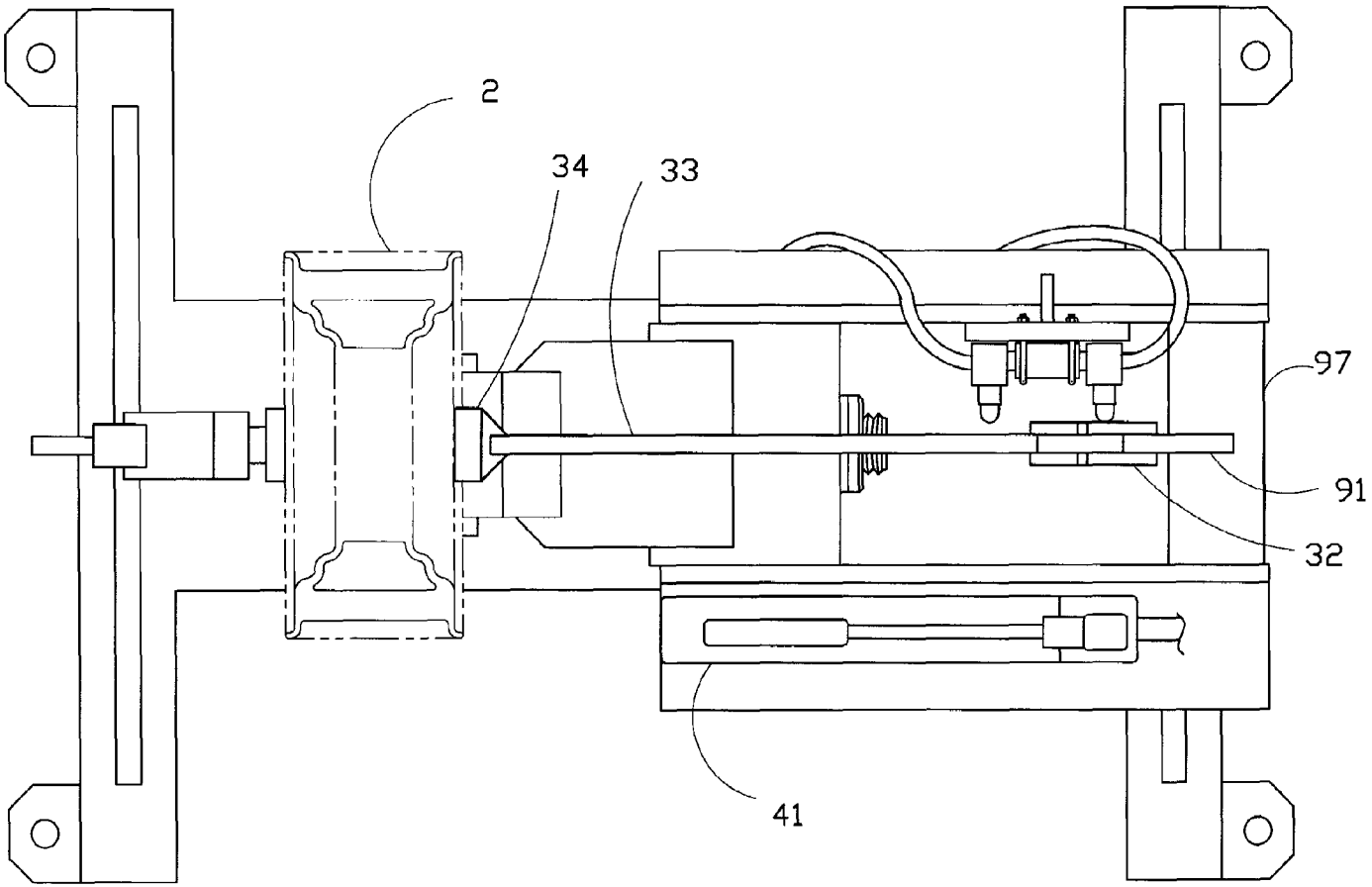
FIG. 27 is a top view showing platform "E" assembly.

FIG. 27 demonstrates a top view of platform "E" 97 assembly showing platform "C" upper arm 33 contacting shoe 34 and wheel rim 2.

The wheel mount axle (FIG. 6*b* part a) is slid through the hub center hole of an automotive wheel rim 2, until the wheel rim 2 comes up flush against the wheel mounting plate 11. While this procedure is being done, care is taken to align the "T bolts" 14 with the bolt holes of wheel rim 2 and to allow them to pass through them, as the wheel slides over the wheel mount axle. Wheel rim 2 has bolt holes as are commonly known.

Figure 6B:
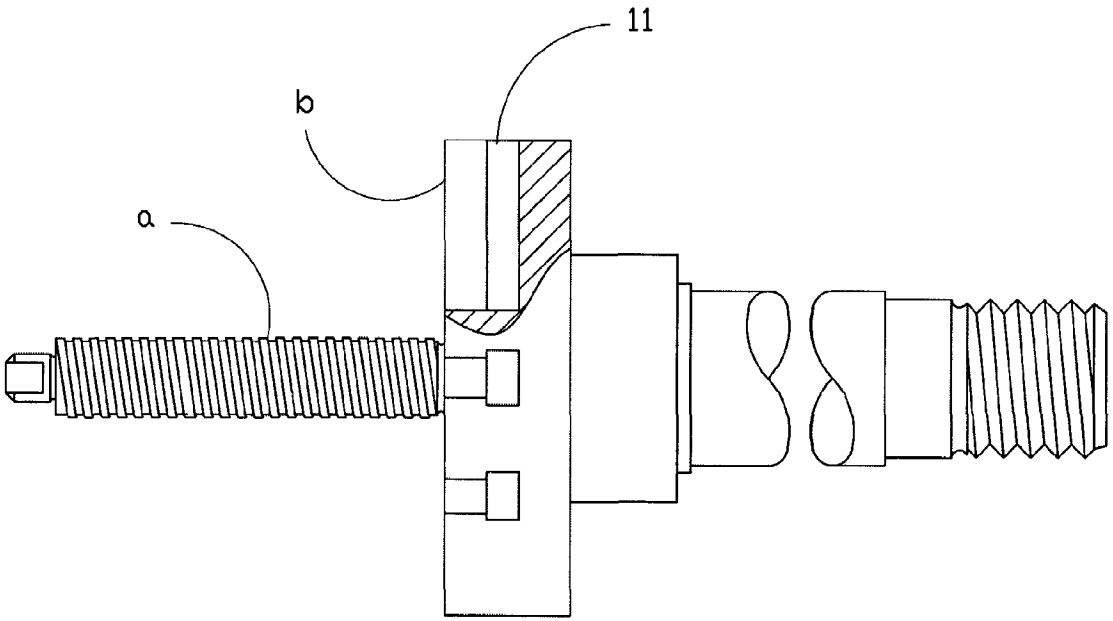
FIG. 6 is an end view of wheel mount axle.
Figure 6A:
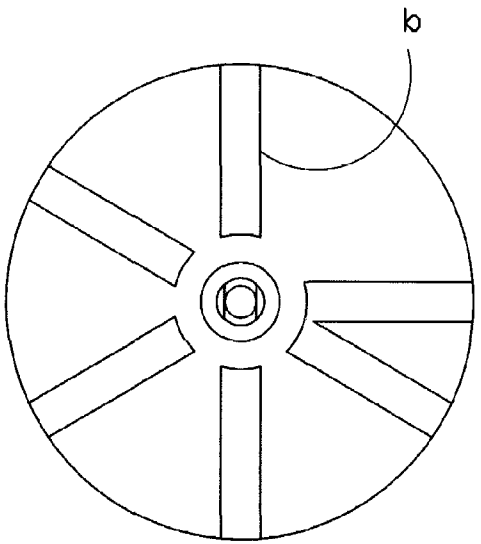

A proportionally sized to hub hole wheel centering cone 16 is slid over the wheel mount axle and positioned in the hub center hole of wheel, This will allow the wheel to centralize over the wheel mount axle (FIG. 6*b* part a).

A wheel centering nut 17 is turned onto the thread of the wheel mount axle (FIG. 6*b* part a) and moved right up to the wheel centering cone to keep it in place.

The wheel is then spun by hand and while watching the distance in gap between the steel shoe (FIG. 7D, element f) and the inner part of the wheel (FIG. 7D, element g) a decision can be made whether wheel is now running true (i.e. no longer bent).

One can also use a dial gauge, or any other device as is commonly known to assist in this procedure which will allow a reading to be taken, should it be necessary or desired to confirm the accuracy of the straightening procedure.

Once wheel rim 2 is running true, it would then be taken off the machine.

Figure 5:
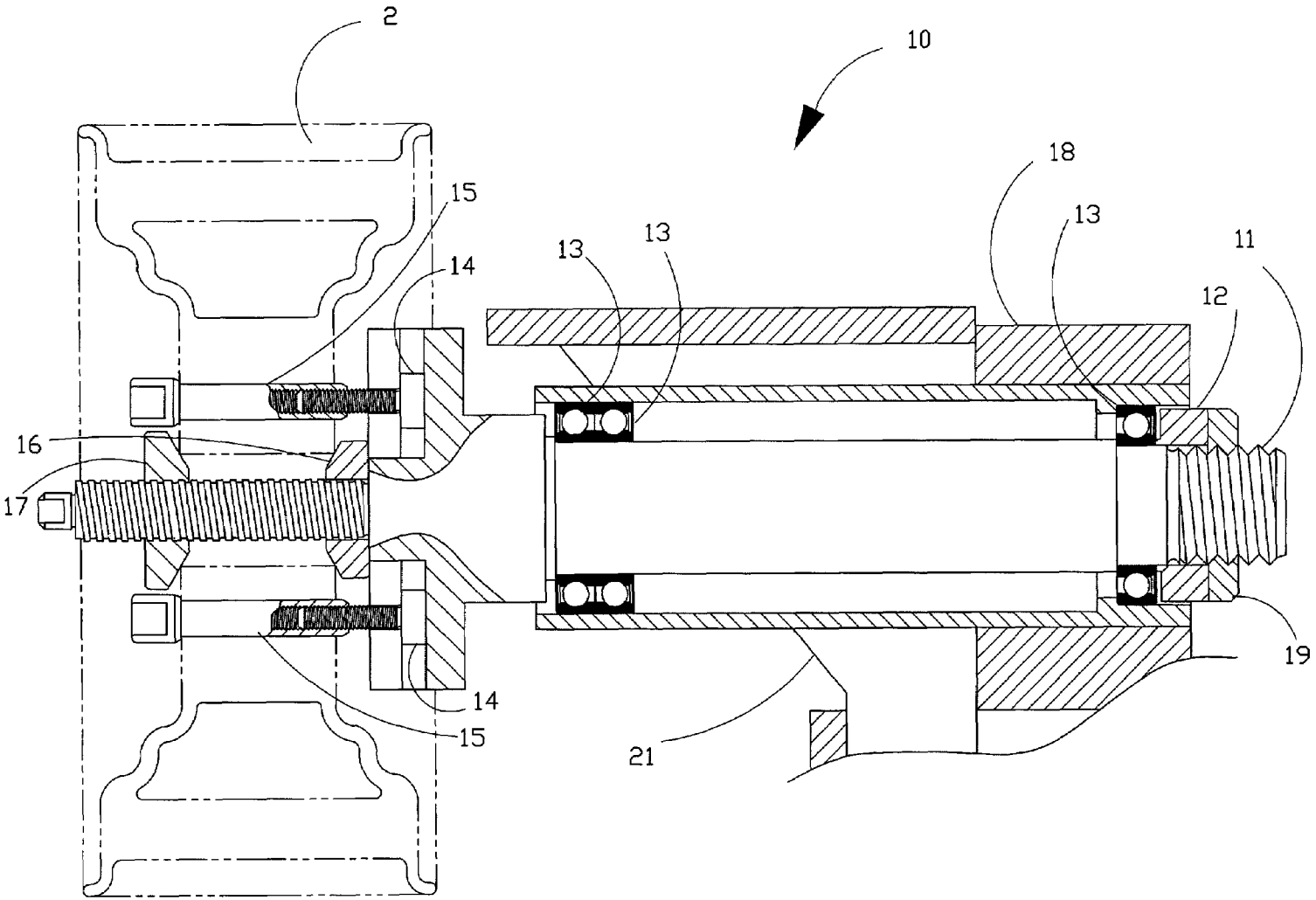
FIG. 5 is a sectional view of the axle mounting assembly.

Should wheel rim 2 be out of round, "T" bolt nuts (FIGS. 5, 15) are screwed onto "T" bolts (FIGS. 5, 14) and tightened down so as to secure wheel rim 2 for repairing. With the use of various methods of applying pressure by the wheel straightening machine, to wheel rim 2, this can be achieved.

Figure 15:
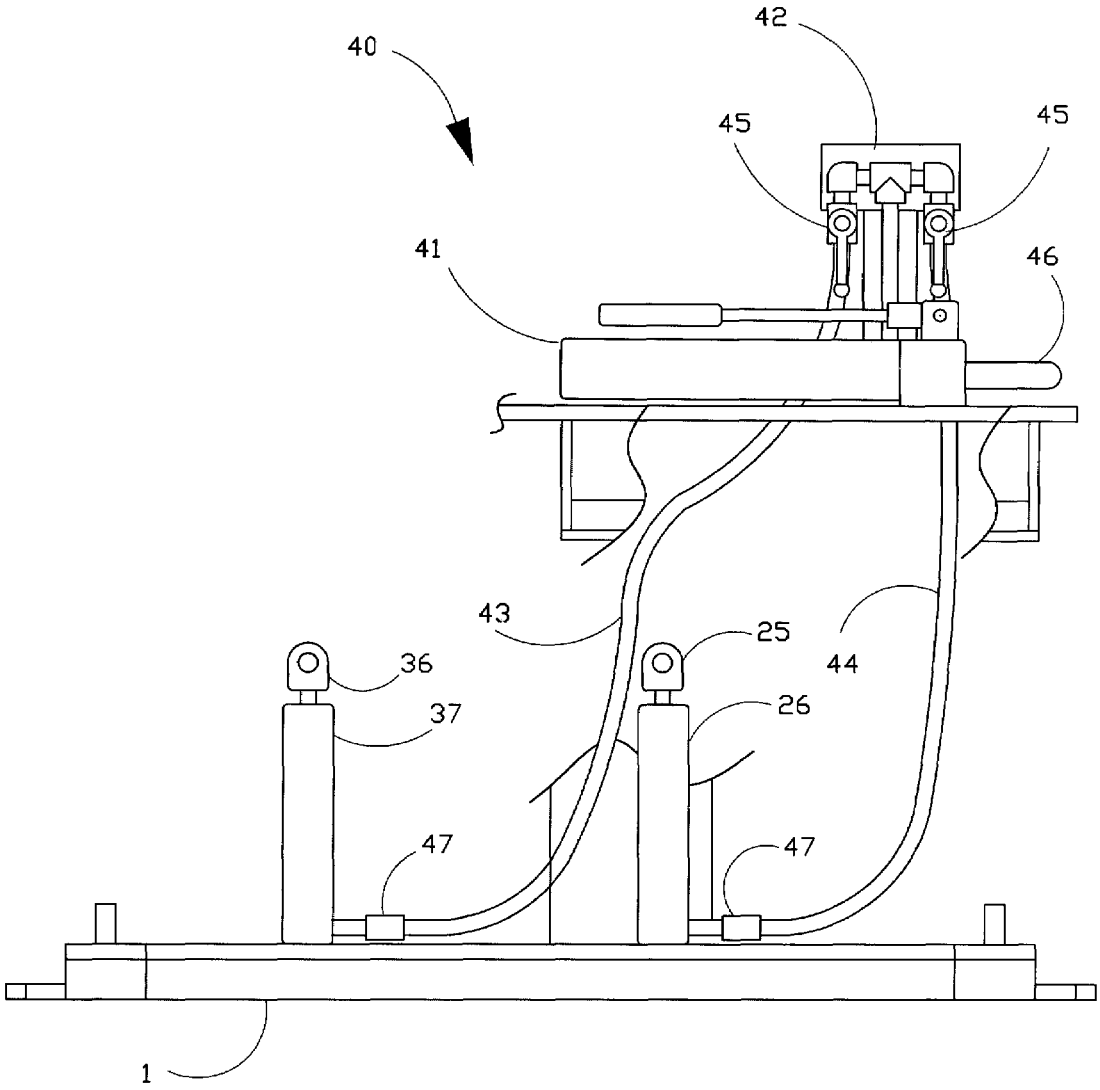
FIG. 15 shows the hydraulic system assembly.

Hydraulic System Assembly (FIG. 15)

Hydraulic pressure can be applied to various parts of the machine either simultaneously or independently). This pressure is applied from a manual hydraulic pump 46 and is then routed through a manifold system 42, with the use of hydraulic on/off valves 45. There could be as little as two on/off valves and or up to four or five on a machine.

The operator now has the ability to now apply pressure on a wheel through the various hydraulic cylinders 37.

Wheel Bent at Rear Dish

The most common place for a wheel to be bent is at the back, where there is no structural strength of a joining center such as spokes.

Should the wheel be bent in this place, it can be corrected in the following manner.

Referring to FIGS. 7*a-d:*

A steel "shoe" (as in FIG. 10, a) is placed onto platform "A" assembly 20. The hydraulic on/off valve 45 for platform "A" 20 is selected from the valves on the hydraulic manifold 42. The platform then has the ability to raise up and down via "manual hydraulic pump" 41.

The steel shoe (as in FIG. 10, a) will be raised to be close to the inner edge of the wheel rim 2 (see FIG. 7, *c*). The wheel rim 2 is then spun by hand. The steel shoe can be used as a guide by comparing distance between the shoe and the wheel while the wheel is being spun by hand. This method can aide in ascertaining the exact position of the bend in the wheel.

Figure 7A:
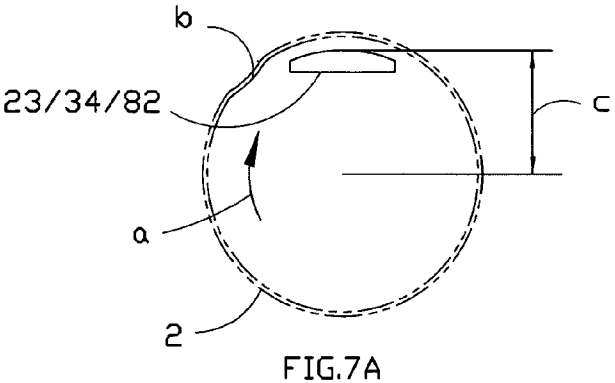
FIGS. 7A-7D show sequential steps in the wheel repair process.
Figure 7B:
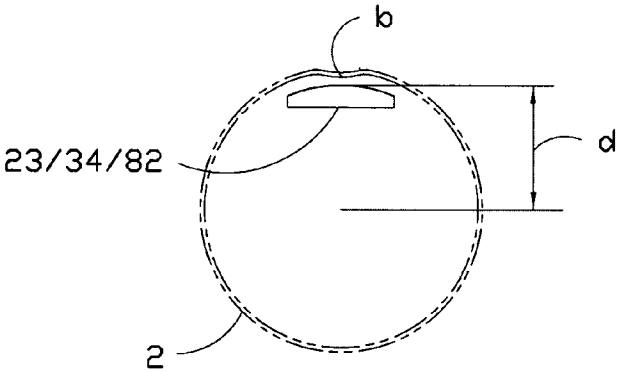
Figure 7C:
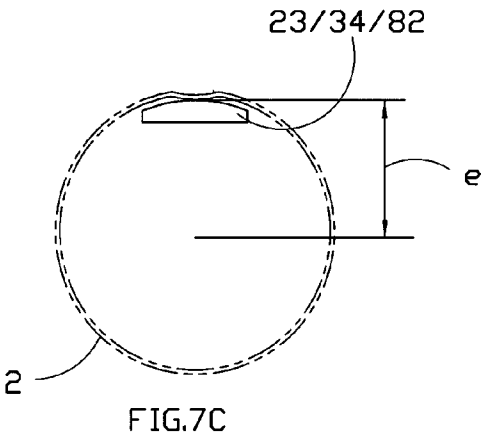
Figure 7D:
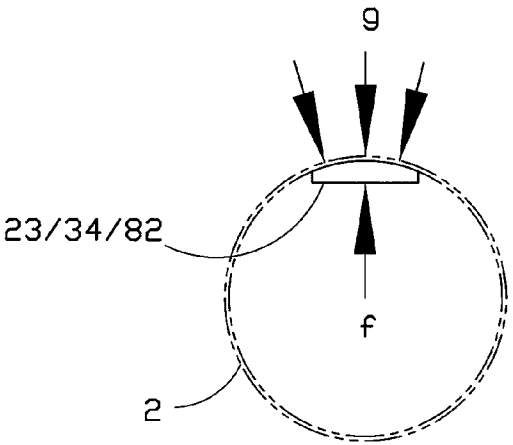

FIG. 7*d* demonstrates when the bend in wheel rim 2 is found, direct upward pressure will be applied to this area.

Occasionally a small downward tap with hammer (on the sides of the bend) can be applied while there is an upward force from platform "A" 20. The point of contact between wheel rim 2 and platform "A" 20, will be the steel shoe (as in FIG. 10, a). The shoe is made to sit at a slight angle so as to conform to the shape of the wheel. On certain wheels and shapes, the shoe can be turned completely around so that the sharper end will lightly embed itself on the wheel so as to prevent it slipping out.

The wheel is then spun again by hand and while watching the distance in gap between the steel shoe (FIG. 7D, f) and the inner part of the wheel (FIG. 7D, g) a decision can be made whether wheel is now running true.

If in doubt in the efficacy of the repair a reading can also be taken with the use of a dial gauge or other suitable instrument as is known to determine if wheel rim 2 has been straightened.

Figure 9C:
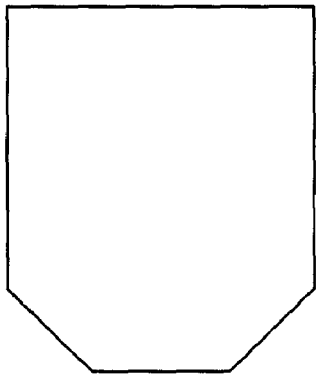
FIG. 9C is a top view of platform "A" slide (21).
Figure 9A:
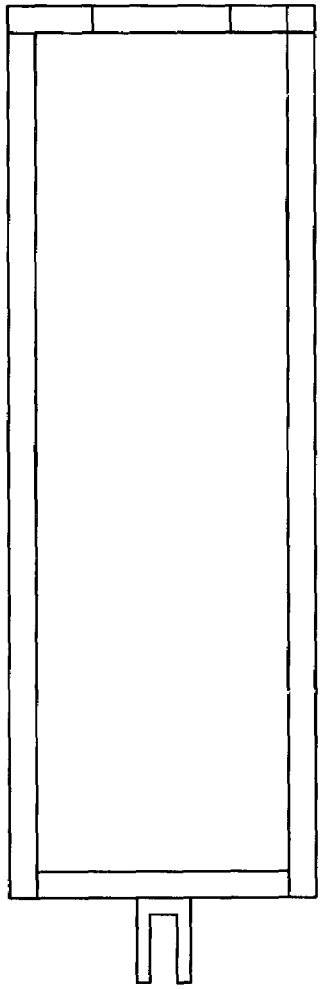
FIG. 9A is a front view of platform "A" slide (21).
Figure 9B:
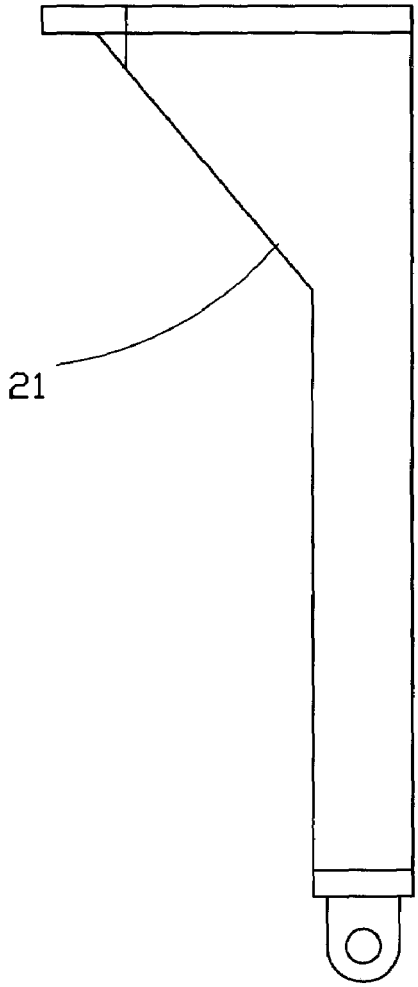
FIG. 9B is a side view of platform "A" slide (21).

The Action of Platform A (FIGS. 9, A, B and C)

Figure 8:
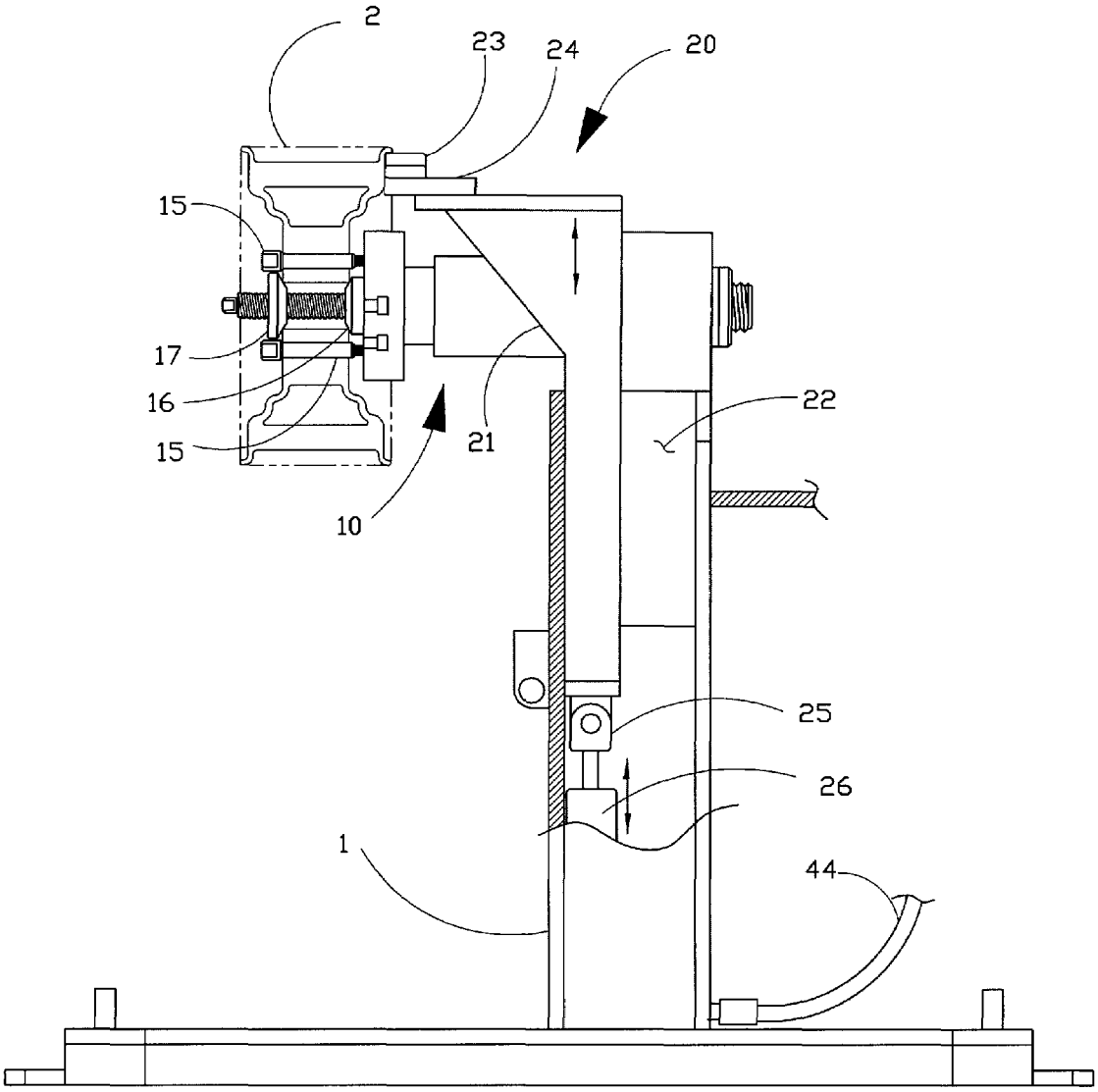
FIG. 8 is a partial section from FIG. 1 showing platform "a" assembly.

The action of platform A 20 will be up and down movement with a slight forward motion while going up (see FIGS. 8, 20, arrows indicating vertical motion).

The slight forward motion is caused by the channel on the main frame of machine having a bit of play thus the wheel shape will cause a general direction or movement of the platform when pressure is applied. Also a lateral bend or buckle can be repaired using platform A 20 as it will not only lift the bend out of the rear of the dish of the wheel, it will also (due to the forward motion) aid in correcting certain lateral bends or buckled wheels.

This forward motion will assist in correcting the damage on wheel rim 2 as a form of reverse engineering has been achieved in this action. In other words, what was done to the wheel is now being reversed in the opposite or reverse direction.

Repair of Wheel Rim Bent Outward

Additionally, as shown in the configuration of FIG. 24, if wheel rims 2 is bent outward, shoe 82 may apply appropriate pressure on wheel rim 2 in order to complete the desired straightening repair.

Front Bend Wheel Repair

Should wheel rim 2 be bent on the front, the hydraulic on/off valve 45 for platform "A" 20 is selected from the valves on the hydraulic manifold 42. The platform then has the ability to rise up and down via "manual hydraulic pump" 41.

The wheel is then placed with the effected area at the 12 'O' clock position.

Platform "A is then raised to apply a small amount of pressure on the back of wheel rim 2. This is done so as to not allow the wheel to bend backwards when pressure is applied to the front.

With the use of the hydraulic manifold 42, platform "A" 20 is then locked in place. Platform "C" 30 is then selected for use and can now be operated via the hydraulic hand pump, Platform "C" 30 will now be able to rise and drop back to position, as shown by directional arrows in FIG. 16. It also has the ability to be placed in various positions and angles on the lifting arm. With the use of slider stops 38, a limited amount of movement of sliding arm connection 32 can be achieved and thus a position of the of platform "C" upper arm 33 can be maintained while upward pressure is applied.

Figure 16:
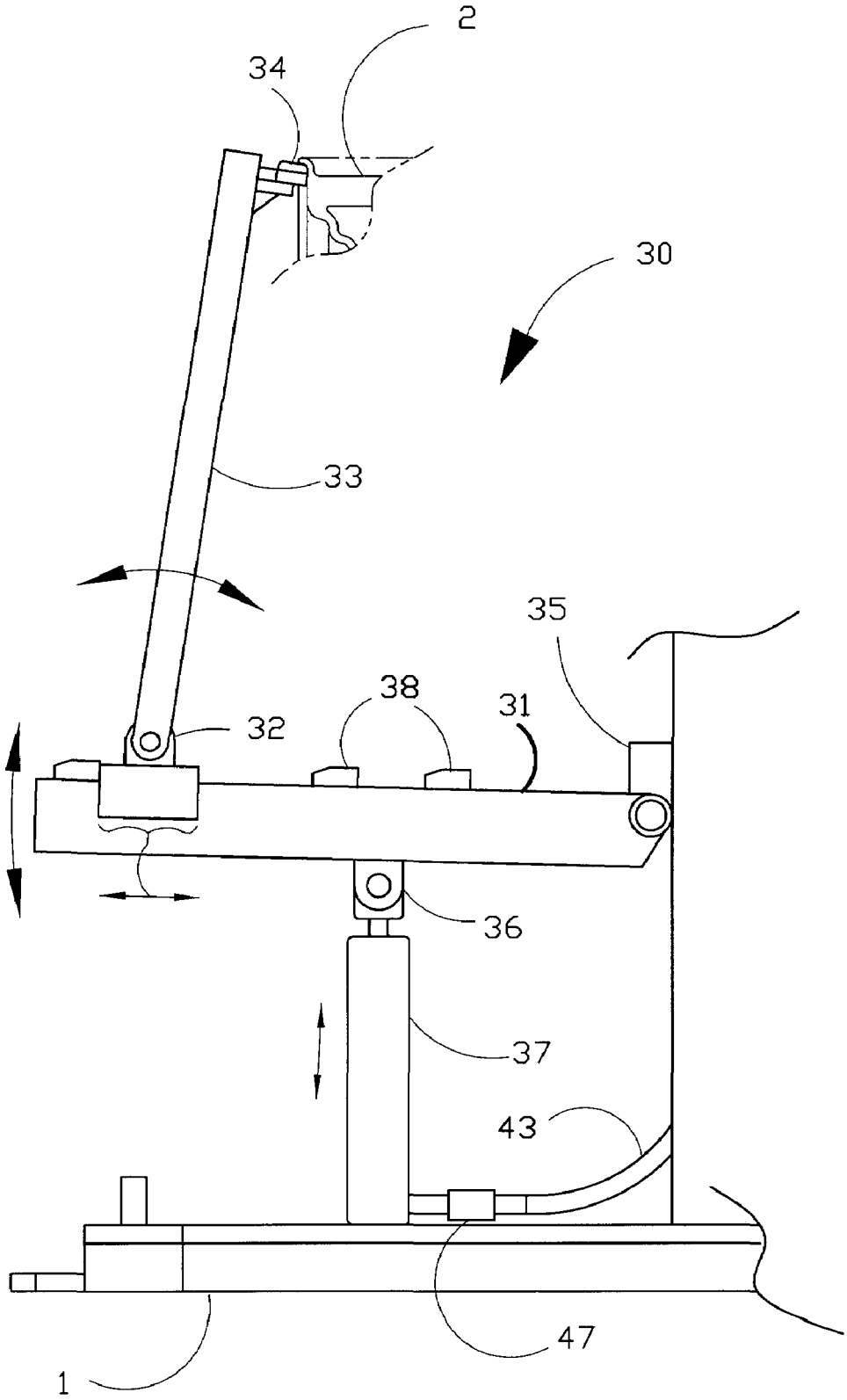
FIG. 16 shows the platform "C" assembly.
Figure 17:
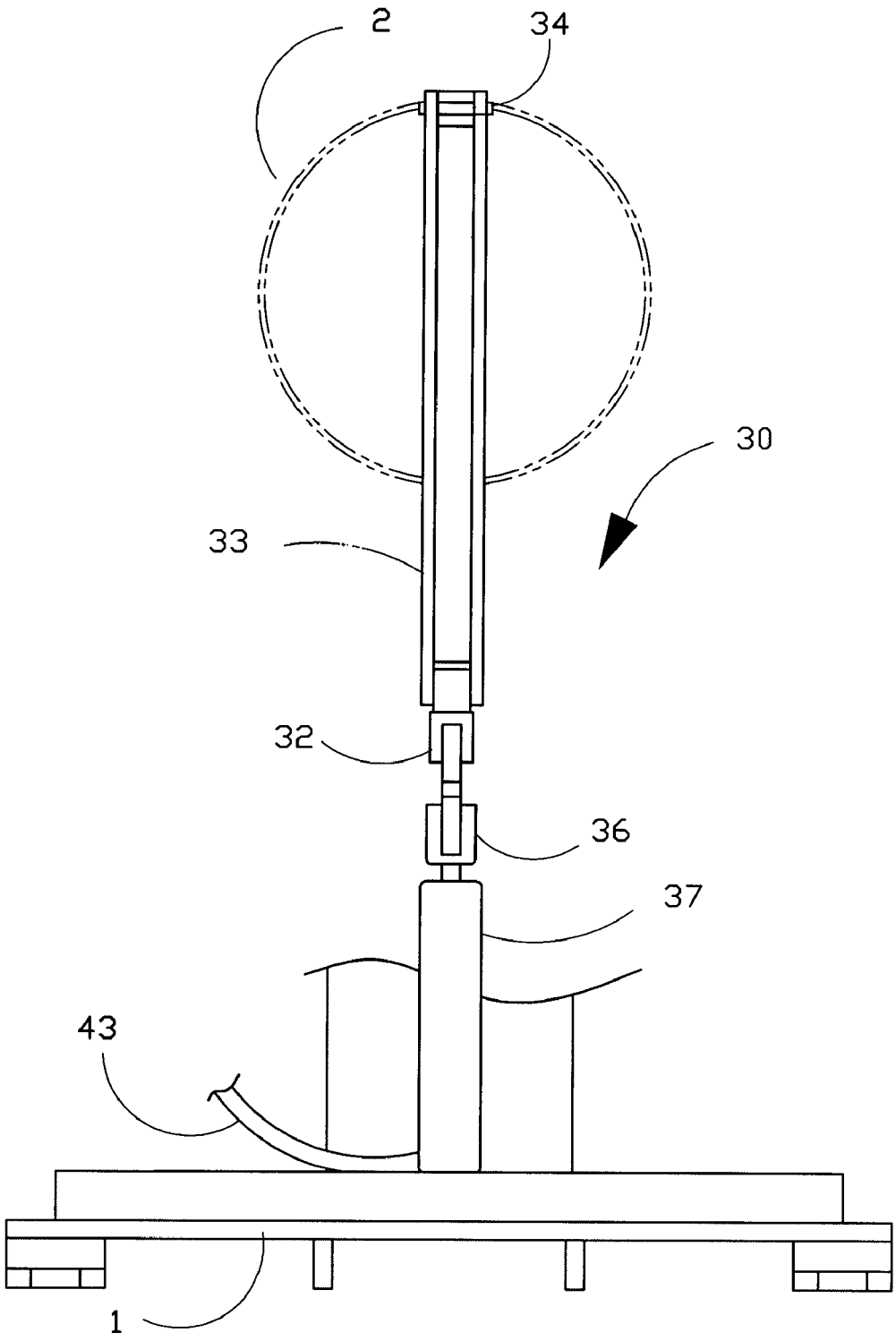
FIG. 17 is a rear view of the hydraulic system assembly.

Platform "C" is now raised so that steel shoe, (FIG. 16, element 34) comes into contact with the effected part of the front lip of wheel rim 2, as shown in FIG. 16.

With direct upward pressure and on occasion a small downward tap with hammer (on the sides of the bend) a straightening action of the wheel can be achieved.

Once achieved the pressure on the wheel is released with the use of the hydraulic manifold.

At any time during this procedure an analysis of the status of the wheel can be achieved by watching the gap between the steel shoe's and the wheel. In addition a dial gauge, or other suitable device for determining the straightness of a wheel rim can be taken on the wheel.

Lateral Bend or Buckle

A lateral bend or buckle in the wheel can be corrected by applying pressure to the wheel in a number of ways.

First Method (See FIG. 24, Configuration 80 "Alternate Use of Platform C")

A reverse action of a buckle or lateral bend can be applied to the wheel with the use of the up and down movement of "Platform C"

This can be achieved by placing "upper/alternate platform C" configuration (FIGS. 24, 80) in between the rising arm 81 and the rear wheel rim 2. This would then apply backward pressure to the wheel when pressure is applied to shoe 82 connected to arm 81 through the raising of platform 30 by hydraulic cylinder 37 and thus the machine operator would have the ability to apply the reverse action of what caused the buckle in the wheel.

Assisting Action

Should the need arise, the operator could also apply pressure simultaneously between Platform C (discussed above) and Platform A (FIGS. 8, 20) while pressure is being applied together or independently to the wheel with the use of use of the hydraulic on/off valves 45. The use of both platforms together described above may correct a defect in the wheel while applying less or minimal force to wheel rim 2 while correcting the damage. In most cases, when a wheel rim 2 is buckled it also has a downward bend in the rear dish of wheel. With the assisting action of "platform A", the buckle and the bend can be removed in one action thus correcting the wheel with minimal force applied.

Second Method (FIG. 26 Platform "E" Assembly)

Pressure is applied via hydraulic ram 95 between main frame of machine 1 and Rotating Pressure Bar 91. While backward pressure is applied to the bottom of the pressure bar, along the direction of the arrows on hydraulic cylinder 95, the top of the bar 91 would move forward toward the wheel as the bar is on a bar to frame pivot 92.

With a use of platform C, upper arm 33, which would be removed from platform C assembly and now used on platform E assembly, as shown in FIG. 26, pressure can be applied in to wheel rim 2 in two areas.

The first area of pressure would be as shown in FIG. 26, which would apply pressure to the back of wheel rim 2 at shoe 34, thus creating an opposite truing action that can eliminate a buckle or lateral bend in wheel rim 2.

The second area of would be applying pressure to the inside of the wheel rim 2. In this case the "rotating pressure bar" (FIGS. 26, 91) would be taller than as shown, thus allowing "platform C/upper arm to extend downward to wheel rim 2 instead of upwards as shown in FIG. 26. This action would also create an opposite truing action that can eliminate a buckle or lateral bend in wheel rim 2.

In both the above cases a suitable shoe (FIGS. 26, 34) would be used to even apply pressure in a larger area on the wheel.

Assisting Action

Should the need arise, the operator could also apply pressure simultaneously between Platform "E" 97 and Platform A 20 while pressure is being applied together or independently to wheel rim 2 with the use of use of the hydraulic on/off valves 45. The use of both platforms 20 and 97 together as described above may correct a defect in the wheel rim 2 while applying less or minimal force to wheel rim 2 while correcting the damage.

In most cases, when a wheel rim 2 is buckled it also has a downward bend in the rear dish of wheel. With the assisting action of "platform A", the buckle and the bend can be removed in one action thus correcting the wheel with minimal force applied.

Alternate Methods of Applying Pressure

In the event that a further method of applying pressure is needed, the hydraulic cylinder/ram 95 that powers platform "E", (FIG. 26) can be removed from its cradle and used to apply pressure directly from the frame of machine to wheel rim 2.

FIG. 18 Alternate Drive/Motorized

An added option to the machine would be to have the wheel be able to be spun via an electric motor 51. This would give one the ability to either do a polished finish on a wheel rim 2 or a lathe action on the wheel rim 2.

The polishing action would be performed while wheel rim 2 is spinning. An abrasive action would be applied to wheel rim 2 by hand via sandpaper or a polish cloth or buff wheel. This could aid the user in finishing the wheel to a certain luster.

The lathe action would be from a x-y axis table (not shown) with a cutting tool attached to the top of it that will allow the user to trim small amounts off non structural parts of the wheel. This could be done for aesthetic or truing purposes (e.g. trimming a wheel that had a weld performed).

Belt Drive

A belt 53 and pulley 54 system is used to apply reduced rotation from electric motor 51 to the main shaft assembly. This will in turn rotate the wheel so that various actions can be applied (listed above) to wheel rim 52.

Because of the need to have the ability to be able to have the wheel free spinning while repairing and not attached to a motor that would slow it down, a clutch system is in place that will eliminate the motor turning when not desired.

With the clutch disengaged, the wheel, while being repaired and spun by hand, will not in any way engage the motor and thus will be able to spin free of any friction that would be created by motor, should it have been a direct to motor drive.

With the clutch engaged, the motor could be powered up via a switch and would then rotate the wheel at the desired reduced speed.

A frequency controller could also be used to electronically control the speed of rotation of the motor and wheel.

Figure 19A:
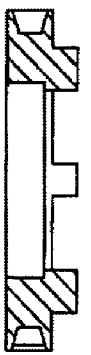
FIG. 19A is a half section of drive pulley (56).
Figure 19B:
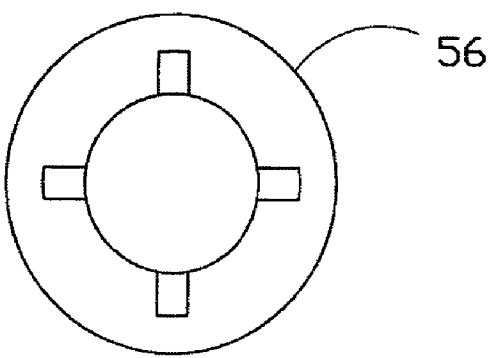
FIG. 19B is a front view of drive pulley (56).
Figure 21:
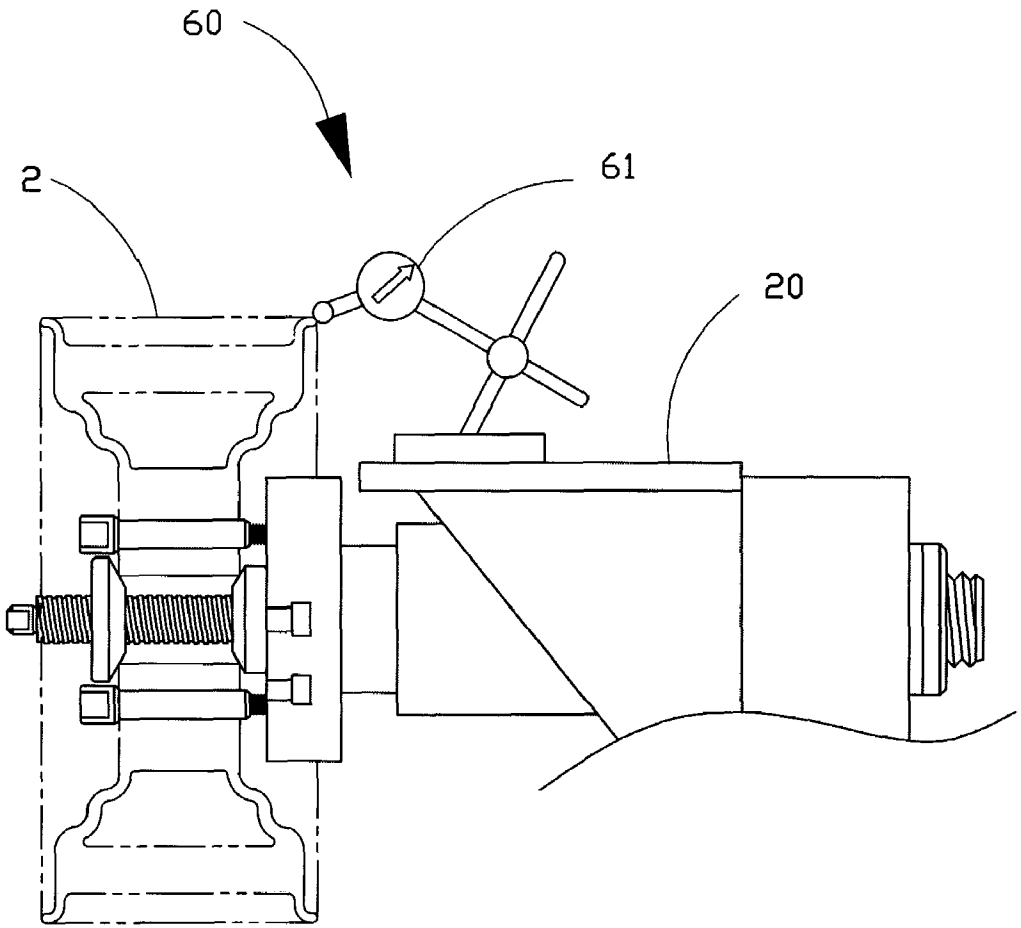
FIG. 21 is a dial indicator.
Figure 25A:
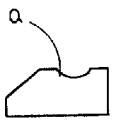
FIG. 25A shows alternative platform "C" shoe (82).
Figure 25B:
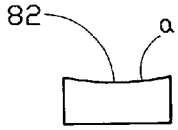
FIG. 25B shows a side view of alternative platform "C" shoe (82).
Figure 25C:
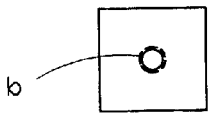
FIG. 25C shows a bottom view of shoe (82) with tapped hole "b" to connect shoe (82) to upper arm (81).

Clutch or Drive Connector Plate (FIGS. 19 and 20)

The method of engaging and disengaging clutch will be by sliding the drive connector plate 57 forward or backward on wheel mount axle 59.

The drive connector plate (FIG. 20, element A) has recesses that will have a glove like effect with the raised sections of drive pulley (FIG. 19, element A) and when coupled together will form a direct drive from the motor to the wheel as the drive key 54 will engage the wheel mount axle.

When the drive connector plate is slid backward the direct drive is broken and wheel rim 2 can now be spun freely by hand.

While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

I claim:

1. A machine for repairing damaged wheel rims comprising:

a. a rotational wheel rim holding spindle;

b. securing means for attaching a wheel rim to said spindle;

c. at least a first movable, hydraulic platform for supporting a shaping shoe; and d. at least one removable shaping shoe placed upon and supported by said first movable hydraulic platform; and e. a support arm for supporting said shaping shoe, said support arm supported by said first movable hydraulic platform.

2. The machine of claim 1 wherein said spindle is rotatable by moving a wheel rim secured thereto.

3. The machine of claim 1 wherein said spindle is rotatable manually.

4. The machine of claim 1 wherein said spindle is rotatable mechanically.

5. The machine of claim 1 further comprising a motor and a clutch, wherein said spindle is rotatably connected to said motor having said clutch to engage and disengage said spindle rotation.

6. The machine of claim 1 having a second movable, hydraulic platform for supporting a shaping shoe for applying pressure to said wheel rim.

7. The machine of claim 6 wherein said second platform moves independent of said first platform.

8. The machine of claim 1 wherein said first movable hydraulic platform supports a shaping shoe for applying pressure on an interior portion of said wheel rim.

9. The machine of claim 1 wherein said removable shoe has varying sizes, shapes, compositions, and hardness levels.

10. The machine of claim 6 wherein said second movable hydraulic platform holds a shaping article to repair damaged wheel rims.

11. The machine of claim 10 wherein said shaping article is a shaping shoe, hydraulic ram, or other shaping object.

12. The machine of claim 1 wherein said lifting arm supports a shaping shoe.

13. The machine of claim 8 wherein said pressure application is applied without interfering with a sight line between a user and a wheel rim.

14. A method of repairing a damaged wheel rim comprising the steps of:

a. mounting a damaged rim on the spindle of a machine of claim 1;

b. identifying the portion or portions of a wheel rim in need of repair;

c. selecting an appropriate pressure application point for repair of said damaged wheel rim;

d. applying pressure from the machine of claim 1 to the area in need of repair;

e. removing said wheel rim from said machine.

15. The method of claim 14 wherein said step of applying pressure to said wheel are in an unobstructed sight line from the user of said machine.

* * * * *